United States Patent [19]

Hall

[11] Patent Number: 4,504,002

[45] Date of Patent: Mar. 12, 1985

[54] TRAMPER'S PACKS

[75] Inventor: Robert E. Hall, Christchurch, New Zealand.

[73] Assignee: Macpac Products (N.Z.) Limited, Christchurch, New Zealand

[21] Appl. No.: 517,377

[22] Filed: Jul. 26, 1983

[30] Foreign Application Priority Data

Aug. 30, 1982 [NZ] New Zealand ..... 201751

[51] Int. Cl.[3] ..... A45F 3/10

[52] U.S. Cl. ..... 224/211; 224/262

[58] Field of Search ..... 224/211, 215, 262

[56] References Cited

U.S. PATENT DOCUMENTS

| | | | |
|---|---|---|---|
| 4,013,201 | 3/1977 | Potter | 224/262 |
| 4,099,657 | 7/1978 | Zufich | 224/262 |
| 4,214,685 | 7/1980 | Pletz | 224/211 |
| 4,303,186 | 12/1981 | Ollinger | 224/211 |
| 4,318,502 | 3/1982 | Lowe et al. | 224/211 X |

*Primary Examiner*—Steven M. Pollard

*Attorney, Agent, or Firm*—Holman & Stern

[57] ABSTRACT

A tramper's pack comprising a sac and hip-belt secured to the sac by a load-transmitting connection comprised of a flexible webbing secured between substantially the mid-point of the width of the back of the sac and substantially the mid-point of the length of the hip-belt, the webbing being dimensioned and arranged to permit relative movement between the hip-belt and the sac in at least three directions; twisting, up and down, and in a curved plane parallel to the plane of the wearer's back. A buckle may be attached to each side of the sac and a stabilizer strap may be provided on each side of the hip-belt, each strap being adjustable in length and releasably securable to the buckle on the adjacent side of the sac. The webbing may comprise a first length secured between the hip-belt and one side of a buckle and a second length secured between the sac and the other side of the buckle, and the second length may be adjustable in length.

4 Claims, 8 Drawing Figures

TRAMPER'S PACKS

BACKGROUND OF THE INVENTION

1. Field of the Invention

The present invention relates to improvements in tramper's packs.

2. Description of the Prior Art

A tramper's pack comprises a sac in which equipment may be carried, the sac being unframed or mounted on an external or internal frame, and a shoulder harness secured to the sac by means of which the sac is supported on the wearer's back. Carrying a heavy load supported only from the shoulders can lead to backache or even to back damage, so many modern packs include a hip-belt connected at or close to the base of the sac, to transfer some of the load from the shoulders to the hips. However, although using a hip-belt alleviates the loading on the back, the hip-belt itself causes problems to the wearer, due to the way in which the human body moves when walking, as illustrated in FIGS. 1–4 of the accompanying drawings.

When a human being walks, he leans backwards and forward with each step (FIG. 1) and from side to side with each double step (FIG. 2). As he leans to the supporting side when taking a step the torso compresses and extends on the stepping side (FIG. 3); this means that, viewing the person from the front, the person's hips pivot up and down around an imaginary center line (indicated in broken lines in FIG. 3). This is termed 'up and down' movement in the present specification. In addition, as shown in FIG. 4, the person's hips move with his legs, but his torso and arms swing in the opposite direction, with the body pivoting at the waist. In FIG. 4, a line through the shoulders is indicated by line S—S and a line through the hips is indicated by line H—H. As shown in FIG. 4, there is a considerable relative rotation between the shoulders (line S—S) and the hips (line H—H) with each step. This is termed 'twisting' movement in the present specification.

Also, when a human being bends or steps up, his back extends; the further the person leans forwards, the longer his back becomes. This extension of the back is in a curved plane, following the natural curve of the back.

Because of the above described movements, a hip belt which is rigidly secured to the pack, and which therefore moves with the pack, is very uncomfortable for the wearer, because the hip belt is constantly rubbing against the wearer due to the relative movements of different parts of the wearer's body when walking. The hip belt cannot be loosened to prevent this rubbing, because the belt must fit snugly to transmit load to the wearer's pelvic girdle and relieve the load on his back. FIG. 5 of the accompanying drawings shows, in diagrammatic form, the effect of a person wearing a pack with a rigidly-secured hip-belt bending forwards; the back extension raises the pack and lifts the hip-belt from the hips, applying uncomfortable pressure across the front of the lower abdomen (arrow P).

Known designs of hip-belt either are secured rigidly to the pack or allow very little relative movement, in one plane only, between the pack and the hip-belt.

BRIEF SUMMARY OF THE INVENTION

It is therefore an object of the present invention to provide a tramper's pack in which the hip-belt is secured to the sac in such a way as to provide a load-transmitting connection which, when the sac is secured to the wearer's back and the hip-belt secured around the wearer's hips, permits relative movement between the wearer's back and hips, (and hence between the sac and the hip-belt) in at least three directions; twisting, up and down, and in a curved plane parallel to the plane of the wearer's back.

The present invention provides a tramper's pack incorporating a sac and a hip-belt secured to the sac by a load-transmitting connection comprising a flexible member secured between substantially the midpoint of the width of the back of the sac and substantially the midpoint of the length of the hip-belt, said flexible member being dimensioned and arranged so as to permit relative movement between the hip-belt and the sac in at least three directions; twisting, up and down and in a curved plane parallel to the plane of the wearer's back; said pack also incorporating a sac and a hip-belt secured to the sac by a load-transmitting connection comprising a flexible member secured between substantially the midpoint of the width of the back of the sac and substantially the midpoint of the length of the hip-belt, said flexible member being dimensioned and arranged so as to permit relative movement between the hip-belt and the sac in at least three directions: twisting, up and down, and in a curved plane parallel to the plane of the wearer's back;

said pack also incorporating a pair of stabilizer straps, each of which is adjustable in length;

one stabilizer strap being releasably securable between one side of the hip-belt and the adjacent portion of the sac and the other stabilizer strap being releasably securable between the other side of the hip-belt and the adjacent portion of the sac.

Said flexible member may comprise e.g. a length of webbing or a first length of webbing secured between the hip-belt and one side of a buckle and a second length of webbing secured between the sac and the other side of the buckle.

BRIEF DESCRIPTION OF THE DRAWING

By way of example only, a preferred embodiment of the present invention is described hereinafter in detail with reference to the accompanying drawings, wherein.

DETAILED DESCRIPTION OF THE PREFERRED EMBODIMENT

Figure 1:
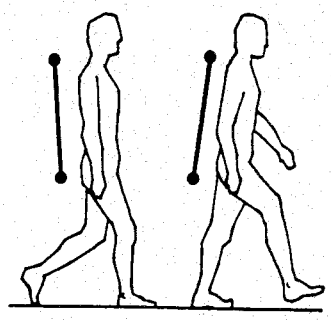
FIG. 1 is a schematic view of a human walking showing the backward and forward leaning motion.
Figure 2:
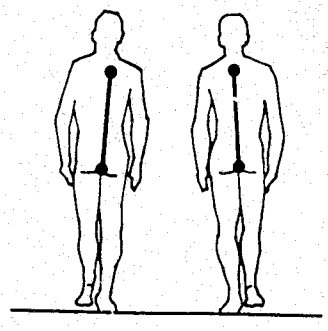
FIG. 2 is a schematic view similar to FIG. 1 showing the side to side leaning motion.

Referring to the drawing, a tramper's pack 2 comprises a sac 3, only the lower part of which is shown, and a shoulder harness of known type (not illustrated). A hip-belt 5 is secured to the back of the sac (i.e. to that surface of the sac which in use faces the back of the wearer).

The hip-belt 5 comprises three integrally formed padded sections 6, 7, 8, the central section 6 contacting the wearer's back in use, and each outer section 7 and 8 being shaped at its free end to cup the wearer's hip joint. The sections 6, 7 and 8 are covered by a continuous cover of waterproof material, but the padding for each section is formed separately, so that the belt can hinge at the joints 9 between the sections of padding. The free ends of the outer sections 7 and 8 terminate just beyond the wearer's hip-joints, and the belt is fastened by a catch or buckle (not shown) of known type secured to the outer sections 7, 8, by adjustable lengths of webbing 10. In use, the hip-belt is fastened around the wearer's hips and the webbing 10 is adjusted in length until the belt fits snugly.

The hip-belt 5 is secured to the remainder of the pack by a single central load-transmitting connection 12; a short length of webbing 13 is passed through one side of a buckle 14 and the ends of the webbing 13 are stitched to the center of the central section 6 of the hip-belt, on the side of the belt facing the sac. The other side of the buckle 14 is connected by a second length of webbing 15 to a point on the center-line of the back of the sac, at or adjacent the end of the back panel of the sac. One end of the webbing 15 is secured to the sac, and the other end of the webbing 15 is passed through the other side of the buckle 14, slid under a retainer 20 secured across the sac, and fastened to a supportin strap 21 secured to the sac. To fit the pack exactly to different wearers, the webbing 15 may be adjusted in length by altering the point at which the webbing 15 is secured to the strap 21. The widths of the buckle 14 and of the webbing 13, 15, are very much less than the length of the central section 6, for example the length of the central section 6 may be 21 cm, and the width of the buckle and webbing about 4.5 cm.

Figure 3:
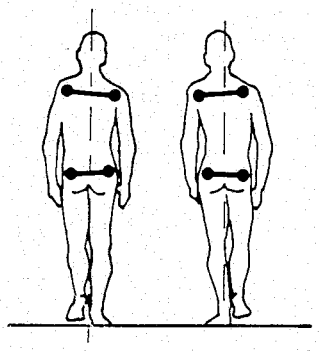
FIG. 3 is a schematic view similar to FIG. 1 showing the up and down movement.
Figure 4:
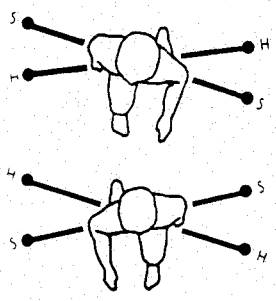
FIG. 4 is a schematic view similar to FIG. 1 showing the twisting motion.
Figure 5:
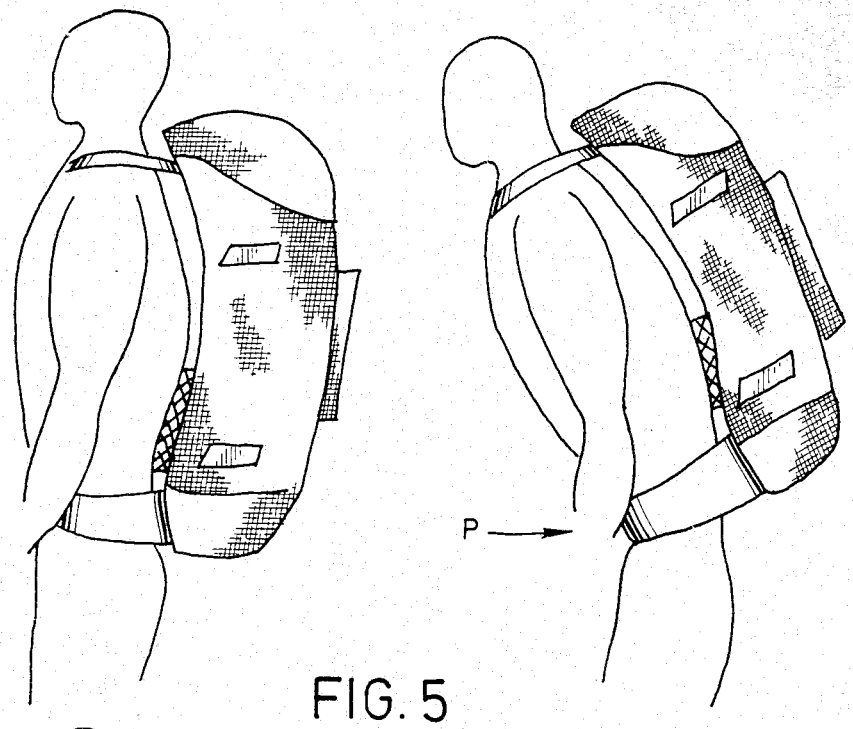
FIG. 5 is a schematic view showing the effect of a back pack with a rigidly-secured hip-belt.
Figure 7:
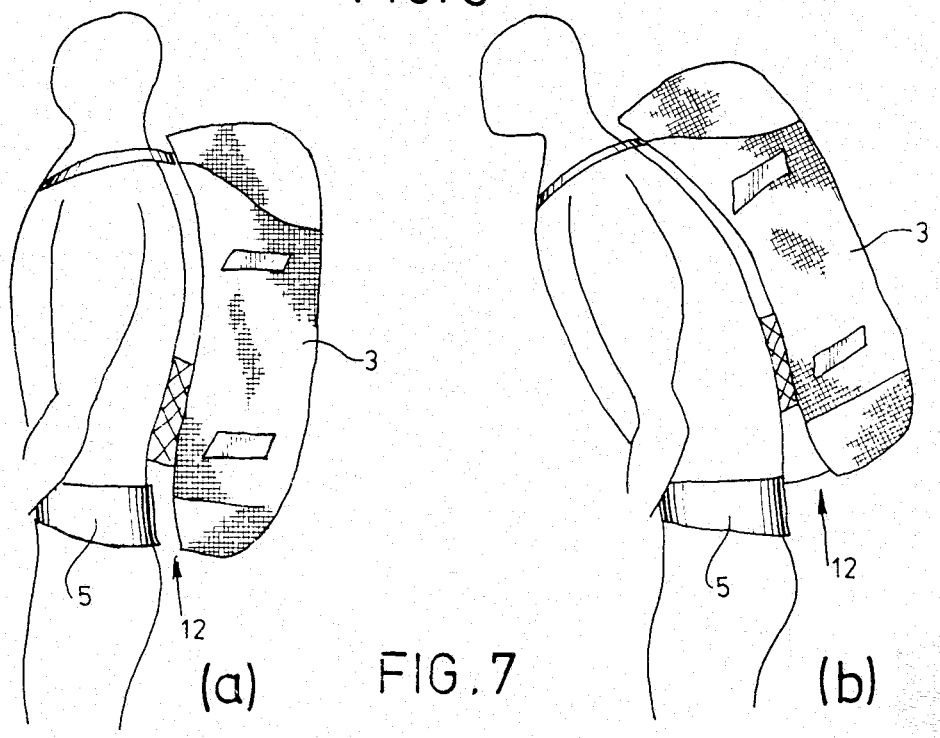
FIGS. 7(*a*) and (*b*) are schematics showing said pack in use.
Figure 6:
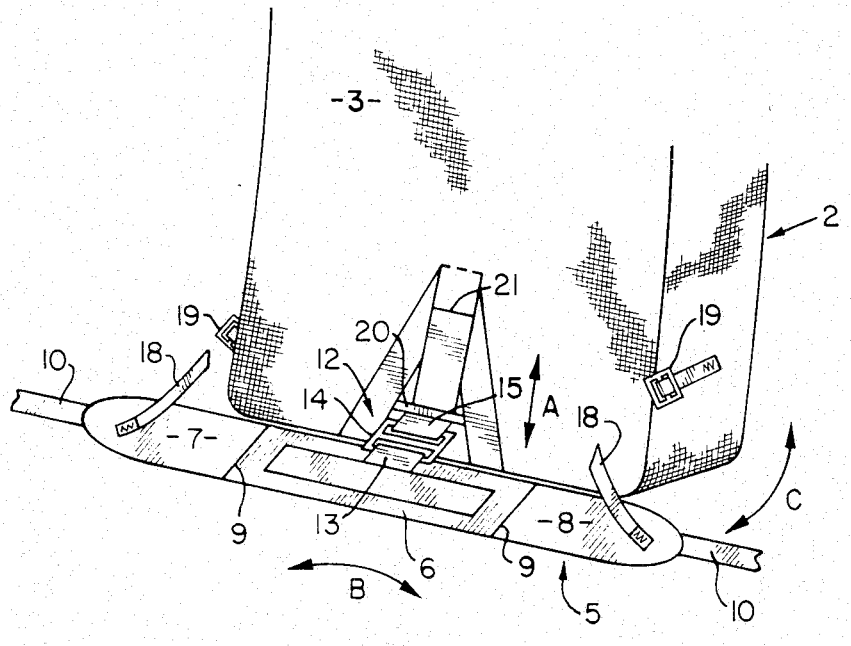
FIG. 6 is a schematic perspective view of the lower part of a tramper's pack in accordance with the present invention, with the hip-belt turned downwards, away from the pack.

The above-described connection 12 permits movement of the hip-belt relative to the remainder of the pack in three directions; up and down movement (FIG. 3 and arrow A in FIG. 6), twisting movement (FIG. 4 and arrow B of FIG. 6) and movement in a curved plane parallel to the curve of the wearer's back (FIG. 5 and arrow C of FIG. 6). FIG. 7 shows said movement in a curved plane; in FIG. *7a*, the wearer is standing straight, and the connection 12 transmits load from the sac 3 to the hip-belt 5. When the wearer leans forward (FIG. *7b*) the connection 12 accommodates the movement of the sac 3 with the wearer's back, without displacing or pulling at the hip-belt 5.

The hip-belt is also connected to the sac by a pair of stabilizer straps 18, each of which is secured at one end to the outer surface (i.e. the surface facing the pack) of the corresponding outer section 7 or 8 of the belt, and at the other end is connected to a buckle 19 secured to the side of the sac at a point slightly above the end of the back panel. For normal tramping use, the stabilizer straps 18 are left loose, so that the do not restrict the movement of the sac relative to the wearer unless the sac swings well away from the wearer. However, if it becomes necessary to secure the sac rigidly to the wearer (e.g. for downhill skiing) then the straps 18 are tightened until virtually no relative movement between the pack and the wearer can occur.

It will be appreciated that the webbing-and-buckle connection between the central section 6 of the belt and the sac could be replaced by any equivalent load-transmitting connection, e.g. a strip of webbing secured between the back panel of the sac and the centre of the section 6 of the belt, said strip being long enough to permit bending and flexing of the strip and so permit the relative movements between sac and belt described above.

I claim:

1. A tramper's pack incorporating a sac and a hip-belt secured to the sac by a load-transmitting connection comprising a flexible member secured between substantially the midpoint of the width of the back of the sac and substantially the midpoint of the length of the hip-belt, said flexible member being dimensioned and arranged so as to permit relative movement between the hip-belt and the sac in at least three directions: twisting, up and down, and in a curved plane parallel to the plane of the wearer's back; said pack also incorporating a pair of stabilizer straps, each of which is adjustable in length; one stabilizer strap being releasably securable between one side of the hip-belt and the adjacent portion of the sac and the other stabilizer strap being releasably securable between the other side of the hip-belt and the adjacent portion of the sac.

2. A tramper's pack as claimed in claim 1 further comprising: a webbing buckle between said hip-belt and said sac; and wherein said webbing comprises a first length of webbing secured between the hip belt and one side of said webbing buckle and a second length of webbing secured between the sac and the other side of said webbing buckle.

3. The tramper's pack as claimed in claim 2 wherein said second length of webbing is adjustable in length.

4. The tramper's pack as claimed in claim 1 wherein said second length of webbing is adjustable in length.

* * * * *